United States Patent [19]

Materese

[11] 4,039,820

[45] Aug. 2, 1977

[54] WATERTIGHT LAMP FIXTURE

[75] Inventor: Vincent Materese, Dayton, Ohio

[73] Assignee: Dayton Manufacturing Company, Dayton, Ohio

[21] Appl. No.: 610,558

[22] Filed: Sept. 5, 1975

[51] Int. Cl.[2] ..... F21V 31/00

[52] U.S. Cl. ..... 240/26; 240/7.5; 240/41.55; 240/51.11 R

[58] Field of Search ..... 240/26, 41.5, 41.55, 240/25, 7.5, 46.59, 93, 106, 106.1, 151, 152, 73 BC, 147, 51.11

[56] References Cited

U.S. PATENT DOCUMENTS

| | | | |
|---|---|---|---|
| 1,337,086 | 4/1920 | Marshall | 240/41.55 |
| 2,481,531 | 9/1949 | Phillips | 240/41.55 |
| 2,791,681 | 5/1957 | Dunker et al. | 240/147 X |
| 2,873,358 | 2/1959 | Dunker | 240/41.55 X |
| 3,046,388 | 7/1962 | Shinn | 240/26 X |
| 3,697,743 | 10/1972 | Eargle | 240/73 BC X |
| 3,780,282 | 12/1973 | Riley | 240/26 X |
| 3,810,085 | 5/1974 | Woloski | 240/147 X |

FOREIGN PATENT DOCUMENTS

| | | | |
|---|---|---|---|
| 853,936 | 11/1960 | United Kingdom | 240/41.55 |

*Primary Examiner*—Edna M. O'Connor
*Attorney, Agent, or Firm*—Biebel, French & Nauman

[57] ABSTRACT

A watertight lamp fixture which is especially adapted for use on offshore oil rigs and other installations where lamps are exposed to severe weather conditions. The fixture is provided with a quick opening and closing latching system to allow workmen to replace bulbs and perform other, similar maintenance in a minimum of time while working under inclement and often dangerous conditions. Additionally, the lamp cover is attached to the body of the lamp in a manner which insures a positive seal between the cover and body of the lamp fixture when the cover is latched in place.

10 Claims, 9 Drawing Figures

WATERTIGHT LAMP FIXTURE

BACKGROUND OF THE INVENTION

In lamp fixtures intended for outdoor use it is essential that the electrical components be sealed against the entry of moisture into the body of the fixture. In this regard see for example U.S. Pat. Nos. 2,279,595; 2,285,728; and 3,069,537, which disclose light fixtures designed primarily for outdoor installations.

The integrity of the seal is particularly important where the unit is likely to be subjected to severe weather conditions, as might be encountered, for example, on an offshore oil rig. In such installations the lamp fixtures are not only subjected to rain, but also are drenched with ocean spray and often immersed in waves. It will be see, therefore, that a good watertight seal is essential.

Another aspect that must be considered in designing lamp fixtures for such places as offshore oil rigs is the fact, that unlike units which are mounted on land installations, routine lamp maintenance can constitute a hazardous task in that the workmen must often climb over the rig under less than ideal conditions. It is understandable therefore that the replacement of bulbs and any other similar routine maintenance should be capable of being performed as quickly as possible.

The necessity of having a watertight lamp fixture and the desirability of having one in which bulb changes and other routines maintenance can be performed quickly present contrary design considerations. For example, two of the most common ways of providing a watertight seal is to have a sealing ring that is clamped in place by a plurality of separately operated dogs or other clamps or held in place by a series of bolts. It will be obvious, however, that unlocking each of serveral clamp mechanisms or manually removing each of the bolts holding a lamp sealing ring in place are time consuming tasks and difficult to perform under adverse conditions.

Thus, a need has existed for a water-tight lamp fixture which will function under severe weather conditions and yet can be opened and closed for bulb changes and the like with a simple, quick acting latching system.

SUMMARY OF THE INVENTION

The present invention provides a water-tight lamp fixture with a quick opening and closing latching system and a cover mounting which provides superior seal compression between the lamp cover and the body of the fixture.

Specifically, the cover is mounted on the body of the fixture for pivoting movement relative thereto and is locked in place at several places by a latch system which permits all latching members to be released or engaged simultaneously.

The latching system includes several hooks with sloped faces which are mounted for sliding movement along the body of the fixture and project upwardly to engage portions of the cover. When the latch hooks are moved into the latching position their sloped faces press the cover down against a resilient seal, such as a closed cell, silicone sponge rubber seal interposed between the body of the fixture and the cover.

Preferably, each of the hooks is provided with ribs or grooves which engage complementary shaped members on the cover. Thus, after the initial camming action which forces the cover toward the body of the fixture and compresses the resilient seal therebetween, the latching system locks into place.

To facilitate closing and opening the latching system, the slide bar carrying the hooks has outwardly projecting portions and a fulcrum is mounted on the body of the lamp fixture to permit a tool, such as a screwdriver, to engage the tool engaging portions of the slide bar and with a lever action, slide the latches simultaneously into opened or closed positions.

The axis of the hinge connecting the cover to the body of the lamp fixture is disposed outwardly of the edge of the fixture body engaged by the seal so that, as the cover swings into place, there is greater movement of the cover and hence, better compression of the seal between the cover and the body of the fixture.

The point at which the latch members engage the cover is also disposed outwardly of the edge of the fixture body and the entire latching system is therefore disposed outwardly of the sealed interior of the lamp and does not interfere in any way with the watertightness of seal between the cover and the body of the lamp.

It will be seen, therefore, that the present invention provides a watertight lamp fixture ideally suited for severe weather conditions and adapted to be quickly opened and closed for routine maintenance and similar operations.

DESCRIPTION OF THE PREFERRED EMBODIMENT

Figure 1:
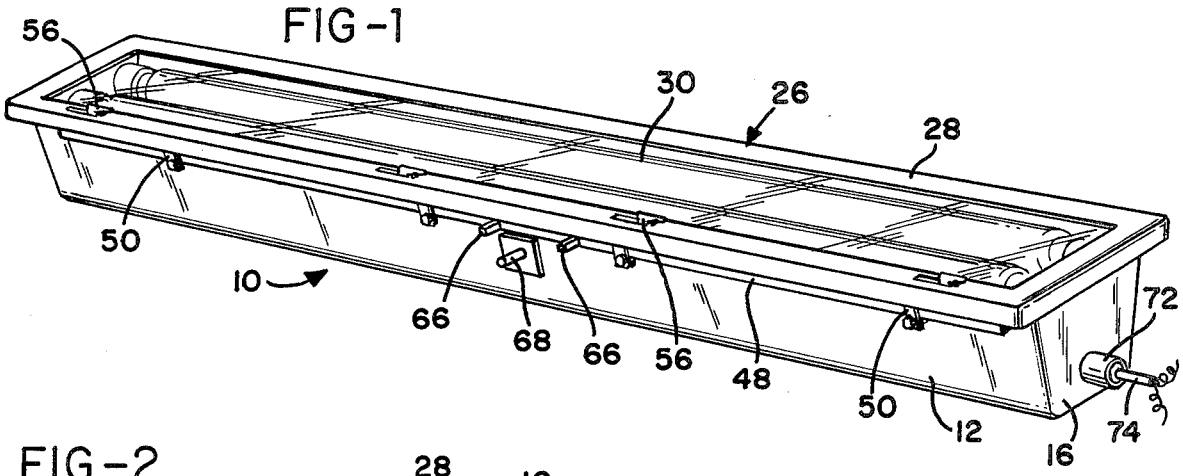
FIG. 1 is a perspective view of a lamp fixture in accordance with the present invention.

With reference initially to FIGS. 1 through 4 of the drawings, it will be seen that a lamp fixture in accordance with the present invention includes a receptacle 10 of troughlike configuration having opposed, longitudinally extending side walls 12 and 14 and end walls 16 and 18 extending between the side walls. Any conventional lighting means can be used, such as the fluorescent tubes 20 which are provided with suitable mounting means 22 and ballast 24.

A cover 26 has a framelike portion 28 within which is secured a light transmitting panel 30. A plurality of blocks 32 (see FIGS. 4 and 8) are secured to the wall 14 of the receptacle and project outwardly a substantial distance therefrom. The cover is provided with a series of channel shaped members 34 corresponding in number to the blocks 32 and pivotally attached thereto as indicated at 36 in FIG. 8 of the drawings.

The periphery of the walls 12, 14 and 18 is defined by the free edges 38, 40 and 42, the corresponding free edge for the end wall 16 being identical to edge 42. The periphery of the walls defining the receptacle 10 engages a continuous resilient seal 44 (see FIGS. 5 through 8 of the drawings) which may be secured by adhesives or in any other convenient manner to opposing portions of the cover 26. Obviously, the seal 44 could be secured to the periphery of the wall and engaged by the opposing portions of the cover.

Figure 8:
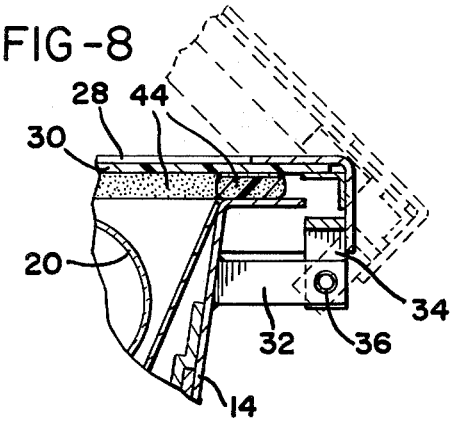
FIG. 8 is an enlarged view of a hinge as seen along line 8—8 of FIG. 4.
Figure 9:
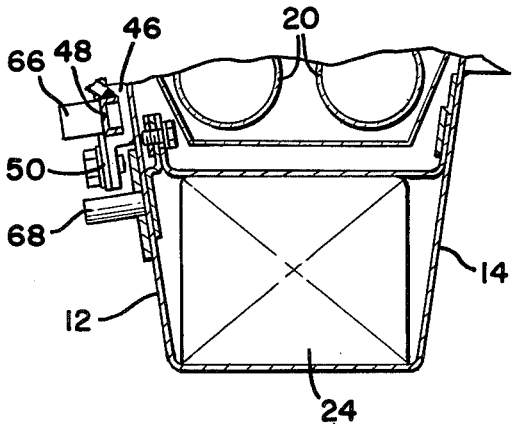
FIG. 9 is a cross sectional view taken on line 9—9 of FIG. 4.

In either case, when the cover is pivoted about the pivot point 36 as shown in FIG. 8 of the drawings, the seal 44 will be compressed between the cover and the receptacle and form a tight seal between these members. In this regard it will be noted particularly from FIGS. 6 and 8 that the pivot point 36 is disposed outwardly a substantial distance from the periphery of the recepticle walls. With this construction it will be apparent that the increased distance which that portion of the cover opposite the free edge of the wall moves during pivoting movement provides better compression of the seal and insures the water tightness of the closed lamp fixture.

Figure 2:
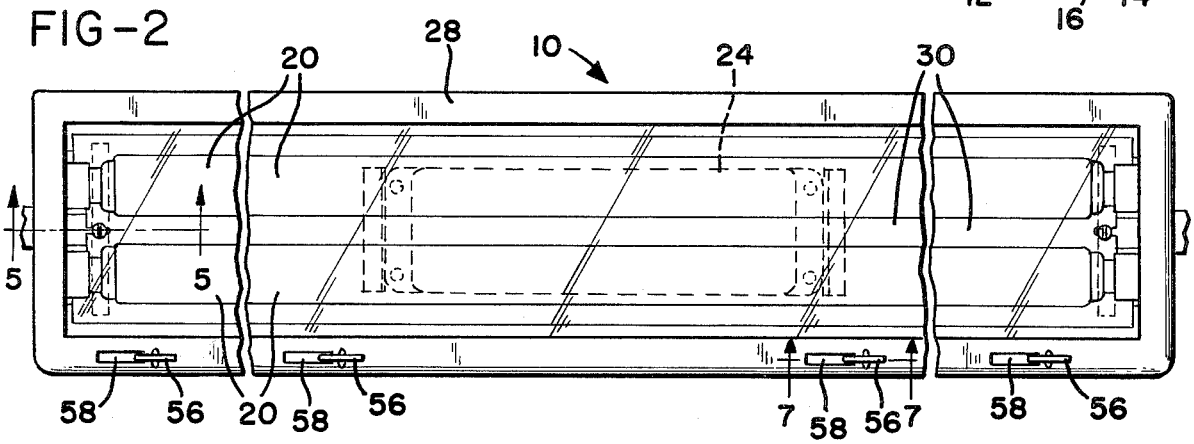
FIG. 2 is a top plan view of the lamp fixture of FIG. 1.
Figure 3:
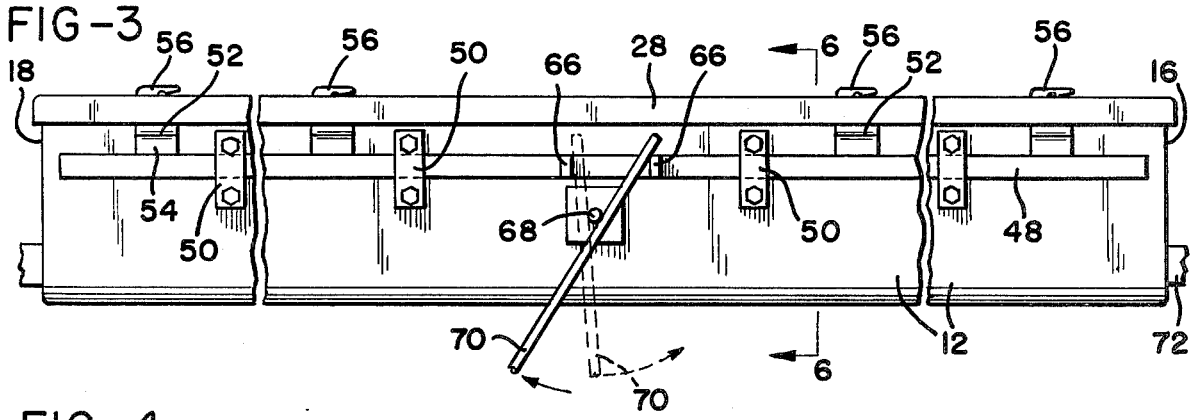
FIG. 3 is a side view of the lamp fixture showing the latching system.
Figure 4:
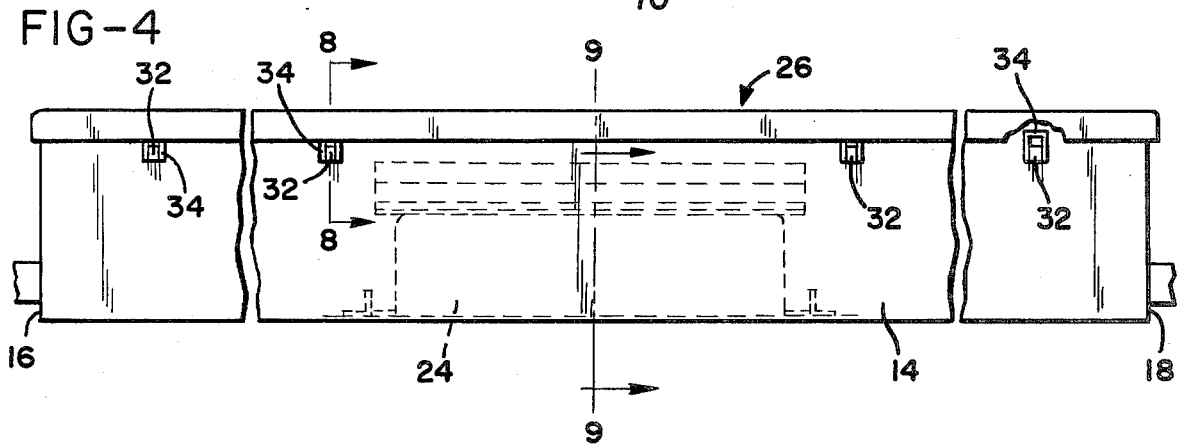
FIG. 4 is a view from the opposite side of the lamp fixture.
Figure 6:
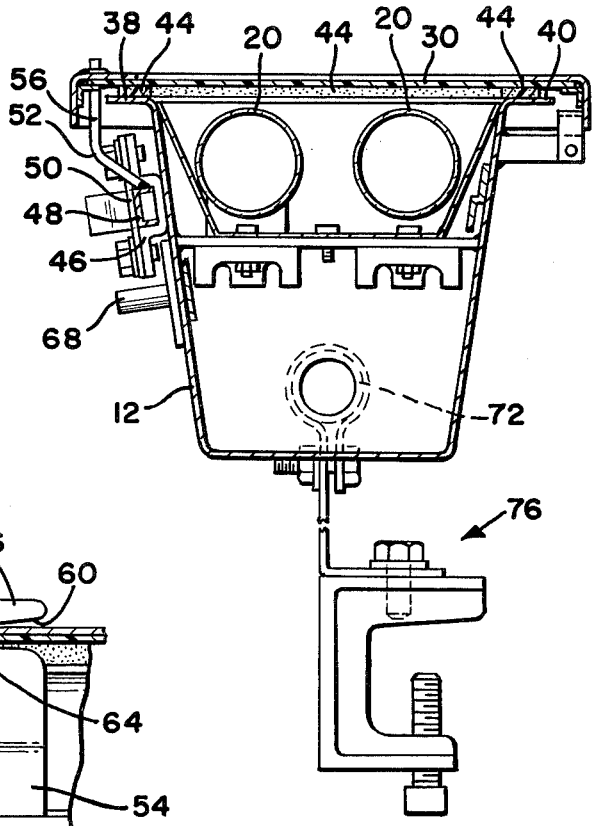
FIG. 6 is a cross sectional view taken along line 6—6 of FIG. 3.

Mounted on the wall 12, as best seen in FIG. 6 of the drawings, are a plurality of brackets 46, within which is held a channel 48, as also seen in FIG. 3 of the drawings, and which is held within the brackets 46 by means of cover straps 50. Attached to the bar 48 are a plurality of latch members 52, each of which includes a base portion 54 and an offset hook portion 56. The hook portions are received in slots 58 formed through the cover 26, as shown in FIGS. 2 and 7 of the drawings, and each of the hook members is provided with a sloped face 60.

Figure 7:
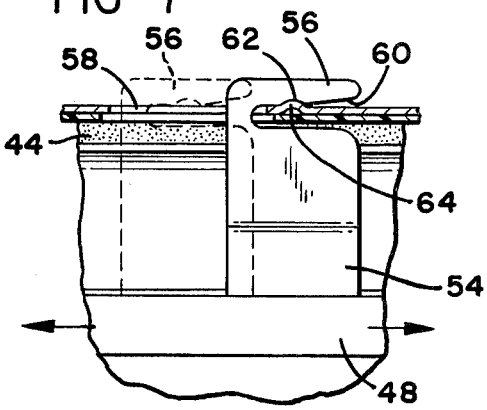
FIG. 7 is an enlarged view of a portion of the latching system as seen along line 7—7 of FIG. 2.

Thus, with the cover closed, if the bar 48 is moved to the right, as seen in FIGS. 3 and 7 of the drawings, the members 52 will move from the dotted line position shown in FIG. 7 to the solid line position, with the sloping faces of the hook members engaging adjacent portions of the cover and pressing the cover down against the seal 44 to form a water-tight seal.

Preferably, the hook members are provided with grooves 62 which engage beads 64 on the cover to provide a snap lock when the latch members are fully seated in te latched position.

Thus, it will be seen that with a simple sliding movement of the bar 48 all of the latching members are moved simultaneously between the latched and unlatched positions, facilitating the replacement of bulbs or other similar maintenance which requires access to the interior of the lamp fixture.

Sliding movement of the bar 48 is attained easily by providing tool engaging portions 66 which, as seen in FIGS. 1, 3 and 6 of the drawings, are mounted on and project outwardly from the sliding bar 48. A fulcrum 68 is fixed to the side wall 12 of the receptacle and provides a convenient point for exerting leverage by means of a screwdriver or other tool 70 to slide the slide bar in the desired direction.

It will often be desirable to group a series of lamp fixtures 10 together in a string of such fixtures and in this regard it will be seen that opposite ends of each of the receptacles can be provided with conduits 72 through which pass cables 74 for interconnecting adjacent lamps. The space between the interior of the conduit 72 and the cables 74 will of course be sealed by means of a resilient bushing or other similar packing to maintain the water-tight character of the lamps.

Figure 5:
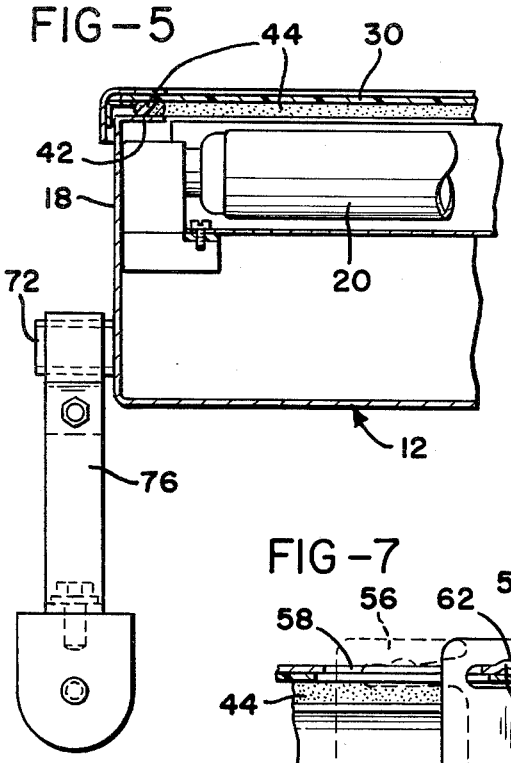
FIG. 5 is a cross sectional view taken along line 5—5 of FIG. 2.

Additionally, and as best seen in FIGS. 5 and 6 of the drawings, each lamp fixture can be provided with mounting brackets 76 at its opposite ends for securing the lamps to the superstructure of an oil rig or other support. It will be noted that the brackets engage the conduits 72 and are clamped thereto as necessary to obtain the desired angular position of the lamp.

From the above it will be seen that the present invention provies a water-tight lamp fixture adapted for use under severe weather conditions but capable of being opened and closed quickly and simply for bulb changes and other routine maintenance.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. In a water-tight lamp fixture including a receptacle formed by an enclosing wall, the periphery of which defines an open mouth of said receptacle, means disposed within said receptacle for mounting lighting means therein and a light transmitting cover received over said open mouth of said receptacle, the improvement comprising:

a. compressible seal means interposed between said periphery of said wall and opposing portions of said cover, b. hinge means connecting said cover to said receptacle and permitting only pivoting movement of said cover about an axis disposed outwardly of said periphery of said wall, c. a plurality of latch means extending between said receptacle and said cover for securing said cover in position over said open mouth of said receptacle with said seal means compressed between said periphery of said wall and said opposing portions of said cover and forming a water-tight seal therebetween, and d. operating means for moving said latch means simultaneously between latched and unlatched positions.

2. The lamp fixture of claim 1 wherein:

a. said hinge means are disposed outwardly of said periphery of said wall.

3. The lamp fixture of claim 1 wherein:

a. said latch means are hook-like members having sloped faces for engaging opposing locking portions, and b. said operating means slides said sloped faces along said locking portions to urge said cover toward said periphery of said wall.

4. The lamp fixture of claim 3 wherein:

a. said operating means comprises a bar carrying said hook-like members and mounted for sliding movement along said wall.

5. The lamp fixture of claim 4 wherein:

a. said operating means has tool engageable portions formed thereon.

6. The lamp fixture of claim 5 further comprising:

a. fulcrum means mounted on and fixed with respect to said wall, b. said fulcrum means being engageable by a first portion of a tool while a second portion of said tool is engaged with said tool engageable portions of said operating means.

7. The lamp fixture of claim 3 further comprising:

a. means defining a plurality of openings through said cover outwardly of said periphery of said wall, b. said hook-like members received through said openings when said cover is positioned over said periphery of said wall, and c. said sloped faces engage said cover adjacent said openings as said hook-like mmembers are moved to said latched position.

8. The lamp fixture of claim 7 further comprising:

a. interengaging beads and notches on said sloped faces and said locking portions.

9. The lamp fixture of claim 8 wherein:

a. said seal means comprises a closed cell, silicon sponge rubber.

10. In a water-tight lamp fixture including a trough-like body having opposite longitudinally extending side walls, end walls extending between said side walls and defining with said side walls said trough-like body, said side and end walls having free edges extending about an open mouth of said body, lighting means disposed within said body and a light transmitting cover received over said free edges of said walls, and improved latching and sealing means comprising:

a. a resilient sponge rubber seal attached to said cover and engaging said free edges of said walls, b. a plurality of hinges mounted along one of said longitudinally extending side walls and connecting said cover to said one wall for pivoting movement of said cover about an axis parallel to but spaced outwardly from the free edge of said one longitudinally extending side wall, c. an elongated bar mounted for sliding movement longitudinally of the other of said longitudinally extending side walls, d. a plurality of hooks attached to said bar and having sloping faces disposed outwardly of the free edge of said other of said longitudinally extending side walls, e. a plurality of slots formed in said cover and receiving said plurality of hooks, f. said sloping faces of said hooks having grooves therein engageable with beads formed on portions of said cover adjacent said slots therein, g. tool engaging portions projecting outwardly from said bar, and h. a fulcrum fixed with respect to said body and projecting outwardly therefrom to serve as a fulcrum for a tool engaging one of said tool engaging portions projecting from said bar.

* * * * *